United States Patent [19]

Eyb et al.

[11] 4,015,303

[45] Apr. 5, 1977

[54] SUPPORT ELEMENT FOR A BRIDGE

[75] Inventors: Wolfgang Eyb, Leonberg; Friedhelm Soffge, Kornwestheim; Ortwin Piper, Schwieberdingen; Gerhard Albrecht, Illingen, all of Germany

[73] Assignee: Firma Dr. Ing. h.c.f. Porsche Aktiengesellschaft, Germany

[22] Filed: May 12, 1975

[21] Appl. No.: 576,446

[52] U.S. Cl. ..... 14/75; 14/1; 14/27; 182/152

[51] Int. Cl.[2] ..... E01D 19/02

[58] Field of Search ..... 14/75, 23, 27, 71, 1; 182/2, 152; 61/46.5; 52/637, 638, 115

[56] References Cited

UNITED STATES PATENTS

| | | | |
|---|---|---|---|
| 1,358,951 | 11/1920 | Helmich | 14/71 X |
| 2,713,402 | 7/1955 | Balogh | 52/115 |
| 2,982,379 | 5/1961 | Fisher | 182/152 X |
| 3,008,158 | 11/1961 | Stinson | 14/71 |
| 3,047,165 | 7/1962 | Hutchinson | 182/152 X |
| 3,177,668 | 4/1965 | Schneider | 52/115 X |
| 3,274,629 | 9/1966 | Gearon | 14/71 |
| 3,323,157 | 6/1967 | Vaugoyeau | 14/27 X |
| 3,354,596 | 11/1967 | Schafer | 182/152 X |
| 3,750,210 | 8/1973 | Barnard | 14/75 X |
| 3,845,514 | 11/1974 | Wagner | 14/2 A |

FOREIGN PATENTS OR APPLICATIONS

| | | | |
|---|---|---|---|
| 1,387,279 | 12/1964 | France | 14/1 |

*Primary Examiner*—Nile C. Byers
*Attorney, Agent, or Firm*—Craig & Antonelli

[57] ABSTRACT

Supporting apparatus for supporting bridge portions on a portable bridge of the type including a plurality of bridge portions movable from storage positions to positions of use connected to one another in series. The supporting apparatus includes two support legs spaced from one another and swingably supported at respective free ends of a pair of pivotally connected carrier sections. The support legs are further connected with one another by a hydraulic-cylinder arrangement arranged in bypassing relationship to the carrier sections with the holding element designed to absorb relative movement of the support legs resulting from the pivotal connection of the carrier section. Swinging devices are also provided at the free ends of each of the carrier sections for applying forcible swinging movement to the support legs so as to fold same from storage to in-use positions. The pivot axis of the support legs extend at an angle of less than 90° with respect to the longitudinal extent of the support legs.

29 Claims, 3 Drawing Figures

SUPPORT ELEMENT FOR A BRIDGE

BACKGROUND AND SUMMARY OF THE INVENTION

The present invention relates to a support element or supporting apparatus including two support legs placed a distance from one another and being pivotally supported adjacent one end thereof at a carrier member and being each provided with a foot plate at the respective opposite ends for engagement with the local ground surface.

Especially in the military area, portable bridges are used consisting of individual bridge portions transportable on bridge placing vehicles. These portions must be mounted on supports with their ends facing one another to form larger bridge spans. For longer bridge portions, they must be provided with additional supports.

In a known bridge construction (FR-PS 1 387,279) composed of a number of transportable and positionable bridge portions, an intermediate support is provided which is formed essentially by a pair of hydraulic support legs pivotally connected at one end of each bridge portion to be swingable about an axle extending transverse to the bridge axis. In this arrangement, the bridge portion is further provided above the intermediate support with a support surface formed by a recess for the free end of the next following bridge portion. Intermediate support is rigidly constructed such that with unequal surfaces resulting during adjustment of the support legs to the local terrain, a high stressing of the support legs and the intermediate support results. Further, with this construction, it is disadvantageous that the support legs are only swingable in one direction parallel to the bridge axis in a transport position and in the opposite direction, the legs take a position inclined to the bridge longitudinal axis.

The present invention contemplates supporting apparatus which avoids the disadvantages described above. The present invention also contemplates providing a supporting apparatus construction of the type mentioned above which can be easily transported with the bridge portions, preferably below same in a space-saving manner. The construction of the present invention also provides that the support for the bridge portions is not dependent upon the local terrain and that the construction thereof is extensively yielding so as to protect the support system from overloading.

An important feature of the present invention is the utilization of a holding element connecting the two support legs with each other and the formation of the carrier for the bridge portions (said carrier being supported at the support legs) as a plurality of separate carrier section which are swingably or pivotally connected with one another by means of a pivot axle.

In preferred embodiments of the invention, the support legs are advantageously supported at the free ends of the carrier sections (ends opposite the connection thereof at the pivot axle). Also in preferred embodiments, the support legs are pivotally supported at the carrier sections for rotation about pivot axles lying in the support leg plane which extend at an angle of less than 90° with respect to the support leg axis. Therefore, the support legs are directionally independently swingable in such a manner that they can be arranged in storage positions under the bridge portions parallel to the bridge longitudinal axis.

According to preferred embodiments of the invention, the support elements (carrier sections and support legs) are constructed to support the bridge portions at any places under the bridge portions, with locking devices being provided at the bridge portions for connecting to the carrier sections. A preferred embodiment of the invention is particularly adapted for supporting the bridge portions at the force-closing connections of two adjacent bridge portion ends.

With the construction of the present invention, a three-hinge connection is formed by way of the pivot axle for the pivotally connected carrier sections as well as the holding element between the support legs, whereby the carrier sections, during overloading of the support system, can yield. That is, the pivot axle connecting the carrier sections, in conjunction with the yielding of the transverse cylinder formed as a holding element, permits yielding movements of the carrier sections during overloading thereof such that the force being supported is advantageously distributed throughout the entire support system. With a construction of the present invention, stresses are reduced which would otherwise occur when the base of the support legs changes during adjustment or as a result of the local terrain when the support legs are differently extended with respect to the local ground surface and are unequally extended. Consequently, the forces conveyed to the support legs are conveyed with the minimal bending moment acting on the support legs due to the three hinge construction referred to above.

Further preferred embodiments of the invention provide wedges arranged on the carrier sections between the bridge portions and the carrier sections. These wedges permit changing of the support legs to attain higher support levels by moving the support legs closer to one another, with consequent pivotal movement of the carrier section at the pivot axle connecting the carrier sections.

Preferred embodiments of the invention also include a swinging device at the head or upper portion of each of the support legs for forcibly moving the same between storage and in-use positions. Each swinging device includes hydraulic cylinders which support themselves at a head plate of the carrier section and have piston rods of the cylinders attached to a segment fastened to the corresponding swinging axle of the support leg. According to a further particularly preferred embodiment of the invention, the cylinders are pivotally supported at the head plate and are connected with levers radially branching from the segment such that during swinging movement of the support legs, the hydraulic cylinders act together in one swinging direction. That is, a plurality of hydraulic cylinders at each support leg act together to forcibly swing the support leg in said one swinging direction. In this manner, after a small rotation of the segment from a neutral central position, the two hydraulic cylinders exhibit a common direction of force.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

A multiple part joinable bridge 1*a* is formed by joinable individual bridge portions 2 and 3 which are transportable and placeable by means of a bridge-placing vehicle (vehicle not shown). In the area of their joining ends, the bridge portions 2 and 3 are supported on support elements or supporting apparatus and are force-closingly connected with one another. The bridge supporting apparatus may support the bridge portions 2 and 3 longitudinally or crosswise to the bridge longitudinal axis. The securing of the supporting apparatus at the bridge portions 2 and 3 is accomplished through locking means. These locking means are not specifically described herein since such could be readily constructed by those skilled in the art, given the present disclosure.

Figure 1:
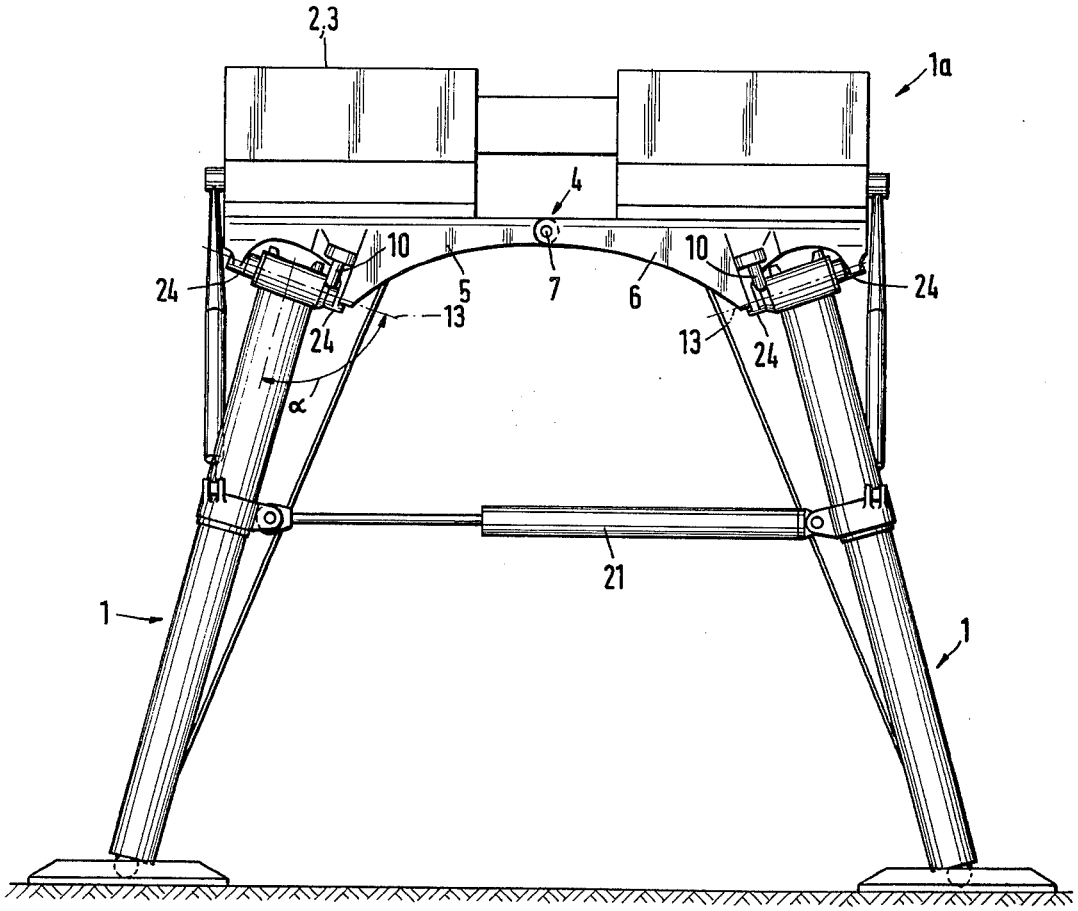
FIG. 1 is a side view of bridge supporting apparatus constructed in accordance with a preferred embodiment of the present invention.
Figure 2:
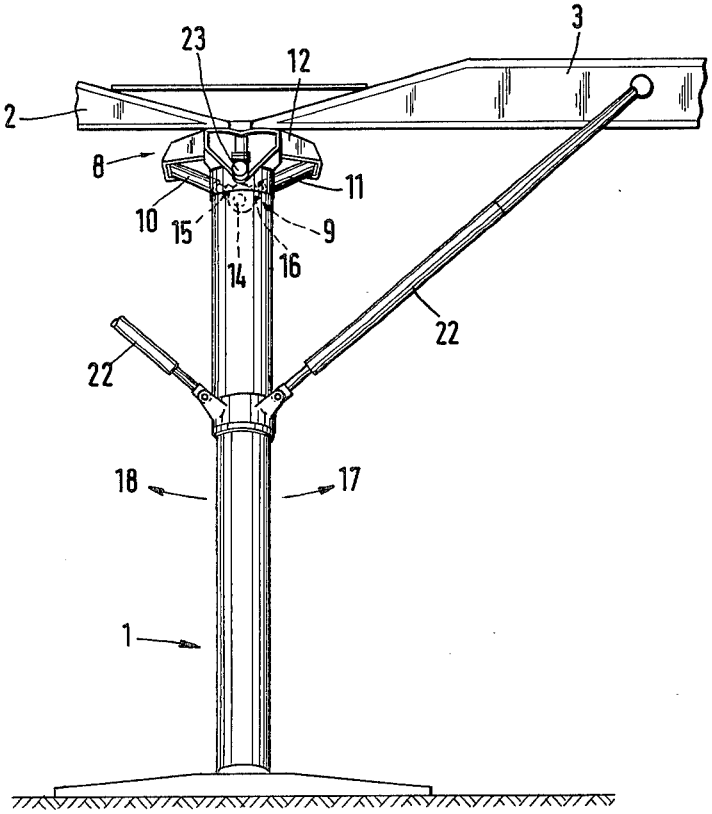
FIG. 2 is a front schematic view of the supporting apparatus of FIG. 1.

The supporting apparatus of the present invention includes a carrier 4 constructed as a saddle support on which the bridge portions 2 and 3 directly support themselves. Support leg 1 are supported at the respective free ends of the carrier sections 4. The support legs 1 include essentially two telescope-like stanchions arranged in one plane (plane of the drawing in FIG. 1) at a distance from one another and being inclined one in relation to the other in the outward downward direction. The support legs are hydraulically operated and provided each at their lower ends with a foot plate engageable with the local ground surface. The stanchions of the support legs 1 are connected to one another through a horizontally arranged holding element 21, preferably constructed as a hydraulic cylinder arrangement. Strut elements 22 are pivotally attached at the support legs 1 and directed inclined to the support plane and engage each at one of the two bridge portions resting on the support leg. On the stanchions a head plate 12 of a respective carrier 4 is mounted, which head plate 12 is constructed symmetrically to the support plane and provided with saddles 23 arranged at both sides of the support legs for the ends of the bridge portions 2 and 3. Locking means are provided above the saddles 23.

The carrier 4 is divided in its longitudinal direction and the carrier sections 5 and 6 are pivotally connected with each other by means of a pivot axle 7. Carrier 4 may therefore be relieved from bending moments which occur during adjustment or after-adjustment of the support legs 1 to accommodate the place or local terrain of erection. The support legs supported at the free ends of the carrier 4 (free ends of carrier sections 5 and 6) are swingable in relation to the bridge portion. For wingably supporting the support legs, a bearing member 24 is provided at the support leg 1 which includes a pivot axle 13 in the support leg plane which extends at an angle $\alpha$ which is smaller than 90° with respect to the support leg longitudinal axis. The support legs 1 can, therefore, be arranged during retraction under the bridge and within the bridges dimensions and therefore, require no special accommodating space.

The swinging of the support legs 1 is accomplished hydraulically. For this purpose, a segment 14 is supported on the pivot axle 13 of the support leg. Hydraulic cylinders 10 and 11 are supported at a head plate 12 of carrier 4 and include respective piston rods engageable with radial levers 15 and 16 of the segment 14. The levers 15 and 16 are provided at the segment 14 in such a manner that for example, after the start of lowering of segment 14, respectively the support leg 1, for example, in the direction 17, both hydraulic cylinders 10 and 11 act in the same direction. That is, upon movement of the support leg from a neutral central position, the radial levers 15 and 16, and the cylinders 10 and 11 are so positioned as to act in the same rotational direction.

Figure 3:
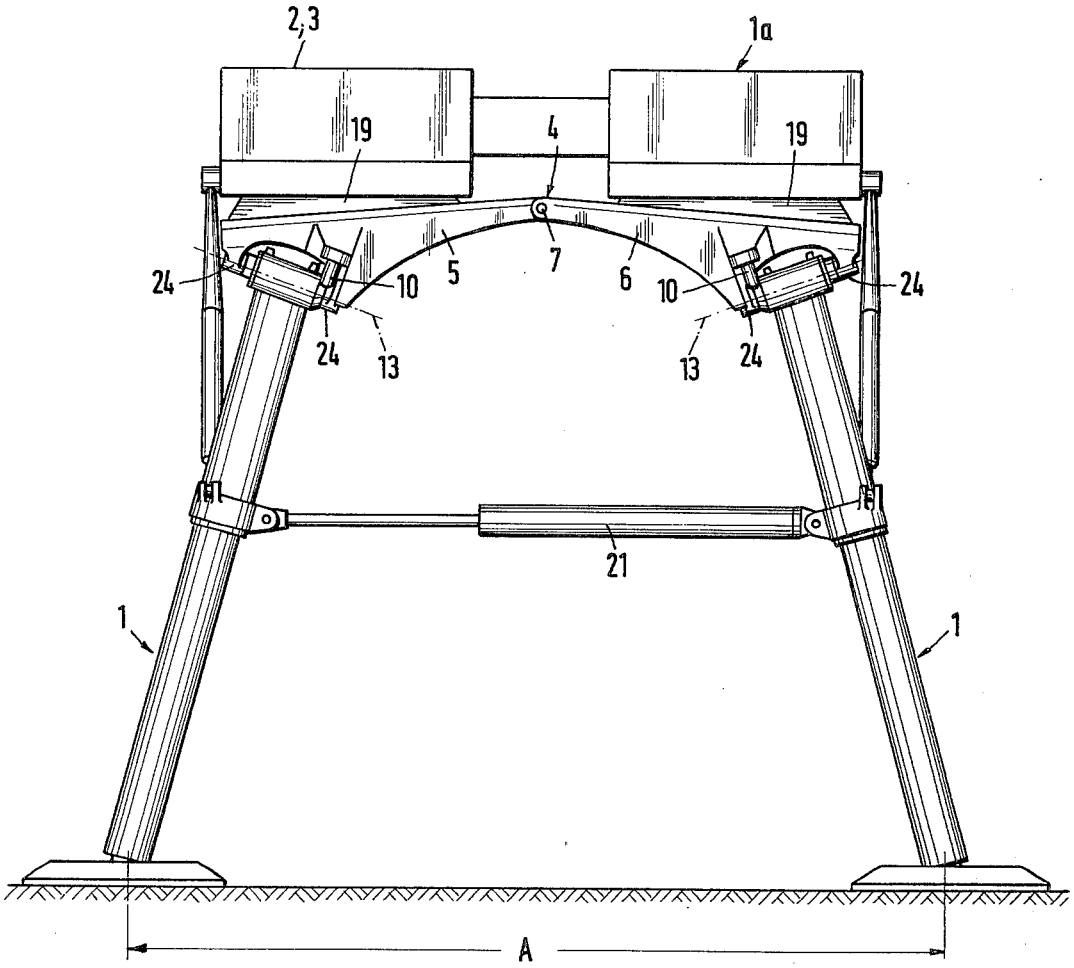
FIG. 3 is a view similar to FIG. 1 illustrating a further preferred embodiment according to the present invention.

According to a further preferred embodiment of the invention illustrated in FIG. 3, the base A of the support legs 1 is adjustable in that wedges 19 are arrangeable on the carrier portions 5 and 6 of the support element, which wedges 19 directly support the bridge portions. To accommodate for the wedges 19, the length of cylinder 21 is adjusted (by appropriate hydraulic means) to pull the legs closer to one another thereby resulting in an inner or based higher support of the bridge portions. The pivotal connection of carrier sections 5 and 6 by way of pivot axle 7 accommodate the insertion of wedges 19 and adjustment of the lateral spacing of the legs is effected by way of adjusting and holding apparatus 21.

The support legs 1 are constructed in such a way that they are exchangeable at any time independent of the arrangement at the carrier sections.

During placing of a bridge consisting of bridge portions 2 and 3 by means of a bridge placing vehicle, the bridge portions together with each pair of support legs 1 are placed progressively one after the other from one bridge head. In this process, the placing of the support legs occurs simultaneously with the placing of a bridge portion in the following manner. The support legs, by means of the head plate of their carrier section and a locking device at the free end of the bridge portion about to be placed, are fastened and together with the lowering of the bridging portion onto the bridge elevation are deposited onto the ground. With its opposite end, the bridge portion is set onto the still free support of the head plate 12 of the positioned support leg 1 of the proceeding bridge portion and is connected to this support leg by means of the locking device. Thereafter, the support strut 22, supported at the stanchion of the support leg 1, is finally connected with the first placed bridge portion. During dismantling of the bridges, the above-noted process is repeated in the reverse sequence. When the supporting apparatus does not serve for the force-closing connection of two bridge portions 2 and 3, but to carry out an additional support function for one bridge portion, a locking means for locking the bridge portions to the carrier sections is additionally provided.

While we have shown and described several embodiments in accordance with the present invention, it is understood that the same is not limited thereto but is susceptible of numerous changes and modifications as known to those skilled in the art and we therefore do not wish to be limited to the details shown and described herein but intended to cover all such changes and modifications as are encompassed by the scope of the appended claims.

To aid in an understanding of this invention, reference is hereby made to two commonly assigned related applications Ser. No. 576,443, 576,444 filed on even data herewith, titled SUPPORT LEG FOR BRIDGES, based on German application P 24 22 895.3 and SWINGABLE SUPPORT LEG FOR A BRIDGE, based on German application P 24 22 932.1

We claim:

1. Supporting apparatus for bridge portions, especially for a portable bridge of the type including a plurality of bridge portions connected to one another; said apparatus comprising:

carrier means for supporting said bridge portions including two carrier sections have the bridge portions mounted thereon, means for pivotally connecting the two carrier elements to one another, said bridge portions being arranged on respective sides of said pivotal connecting means, a pair of support legs spaced from one another;

means for pivotally supporting the respective support legs at free ends of the respective carrier sections for movement between respective storage positions and in-use positions with said support legs supporting said carrier means, and a holding element connecting said support legs to one another, said holding element being separate from and spaced from said carrier means when said support legs are in their in-use positions, wherein said holding element, said pivotal connecting means of said carrier elements, and the respective pivotal supporting means of said support legs are spaced from one another so as to form a three-hinge support for the bridge portions whereby said two carrier sections and the bridge portions associated therewith are adapted to execute compensating movements about the pivotal connecting means in response to at least one of an adjustment of a base of the support legs and an irregularity of a support surface upon which the support legs rest.

2. Supporting apparatus according to claim 1, wherein said means for pivotally connecting said two carrier sections to one another is fashioned as a pivot axle.

3. Supporting apparatus according to claim 2, wherein said support legs are supported at respective ones of said carrier sections by axles having an axis of rotation disposed less than 90° with respect to the longitudinal extent of said support legs.

4. Supporting apparatus according to claim 3, wherein said support legs are similar to and exchangeable with one another.

5. Supporting apparatus according to claim 3, wherein a swinging device is provided at a head of each of the support legs, each of said swinging devices including hydraulic cylinders supporting themselves each on a head plate of one of said carrier sections, with the piston rods of the cylinder rods being connected with a segment fastened on the corresponding swinging axle of the suppport leg, whereby said cylinders are operable to forcibly swing said legs between storage and in-use positions.

6. Supporting apparatus according to claim 5, wherein the cylinders are pivotably supported at the head plate and are connected with levers radially branching off of the segment, and wherein, during swinging of the support leg, the pistons of the hydraulic cylinders at each of said support leg acts jointly in a swinging direction.

7. Supporting apparatus according to claim 1, wherein said support legs are similar to and exchangeable with one another.

8. A support apparatus according to claim 1, wherein said means for pivotally connecting the two carrier sections is a pivot axle extending in a direction substantially parallel to a longitudinal axis of the bridge.

9. A support apparatus according to claim 1, wherein said means for pivotally connecting the two carrier sections is arranged substantially centrally of the pivotal supporting means of the respective support legs.

10. A support apparatus according to claim 9, wherein said means for pivotally connecting the two carrier sections extends longitudinally of the bridge.

11. An arrangement according to claim 1, wherein said means for pivotally connecting the two carrier elements is arranged substantially centrally of the pivotal supporting means of the respective support legs.

12. An arrangement according to claim 11, wherein said means for pivotally connecting said two carrier elements extends longitudinally of the bridge.

13. Supporting apparatus for bridge portions, especially for a portable bridge of the type including a plurality of bridge portions connected to one another; said apparartus comprising:

carrier means for directly supporting said bridge portions including a plurality of carrier sections pivotally connected to one another by a pivot axle, a pair of support legs spaced from one another and swingably supported at said carrier means for movement between respective storage positions and in-use positions with said support legs supporting said carrier means, a holding element connecting said support legs to one another, said holding element being separate from and spaced from said carrier means when said support legs are in their in-use positions, and wedges arranged on the carrier sections between the bridge portions and carrier sections.

14. Supporting apparatus for bridge portions, especially for a portable bridge of the type including a plurality of bridge portions connected to one another; said apparatus comprising:

carrier means for directly supporting said bridge portions including two carrier sections pivotally connected to one another by a pivot axle, a pair of support legs spaced from one another, the respective support legs being swingably supported at free ends of the respective carrier sections by axles having an axis of rotation disposed less than 90° with respect to the longitudinal extent of said support legs so as to permit movement of said support legs between respective storage positions and in-use positions with said support legs supporting said carrier means, said support legs being similar to and exchangeable with one another, a holding element connecting said support legs to one another, said holding element being separate from and spaced from said carrier means when said support legs are in their in-use positions, and wedges arranged on the carrier sections between the bridge portions and carrier sections.

15. Supporting apparatus according to claim 14, wherein a swinging device is provided at a head of each of the support legs, each of said swinging devices including hydraulic cylinders supporting themselves each on a head plate of one of said carrier sections, with the piston rods of the cylinder rods being connected with a segment fastened on the corresponding swinging axle of the support leg, whereby said cylinders are operable to forcibly swing said legs between storage and in-use positions.

16. Supporting apparatus according to claim 14, wherein said holding element includes a hydraulic piston-cylinder device having one end pivotally connected to one of said support legs and the other end pivotally connected to the other of said support legs.

17. Supporting apparatus according to claim 16, wherein said support legs and said holding element lie in a common plane which is substantially perpendicular to the plane of said bridge portions when said support legs are in an in-use support position.

18. Supporting apparatus according to claim 17, wherein each of said support legs is formed of telescoping parts which are hydraulically adjustable with respect to one another to vary the length of the support legs.

19. Supporting apparatus for bridge portions, especially for a portable bridge of the type including a plurality of bridge portions connected to one another; said apparatus comprising:

carrier means for directly supporting said bridge portions, a pair of support legs spaced from one another and swingably supported at said carrier means for movement between respective storage positions and in-use positions with said support legs supporting said carrier means, and a holding element connecting said support legs to one another, said holding element being separate from and spaced from said carrier means when said support legs are in their in-use positions, the holding element includes a hydraulic piston-cylinder device having one end pivotally connected to one of said support legs and the other end pivotally connected to the other of said support legs.

20. A supporting arrangement for a bridge composed of a plurality of bridge sections, the arrangement comprising:

means for supporting the bridge sections including two carrier elements having the bridge sections mounted thereon, means for pivotally connecting the two carrier elements to one another, said bridge sections being arranged on the carrier elements on respective sides of the pivotal connecting means, a pair of support legs, means for pivotally mounting one of said pair of support legs at a free end of one of said carrier elements, means for pivotally mounting the other of said pair of support legs at a free end of the other of said carrier elements, said pair of support legs being mounted at the carrier means so as to be independently pivotal from a storage position disposed beneath the bridge portions parallel to a longitudinal axis of the bridge to an in-use position with the respective support legs being inclined one in relation to the other in an outward and downward direction, and an adjustable holding element for adjustably connecting said support legs to one another, said holding element being separate from and spaced from said two carrier elements when said support legs are in their in-use position, said holding element, said pivotal connecting means of said carrier elements and the respective pivotal mounting means of said pair of support legs being spaced from one another so as to form a three-hinge support for the bridge whereby said carrier elements and the bridge sections associated therewith are adapted to execute compensating movements about the pivotal connecting means in response to at least one of an adjustment of a base of the support legs and an irregularity of a support surface upon which the support legs rest.

21. An arrangement according to claim 20, wherein a distance between the respective support legs form a base of the support legs and means are arranged on said carrier elements for adjusting the base of the support legs.

22. An arrangement according to claim 21, wherein said base adjusting means are interposed between a bridge portion and a respective carrier element.

23. An arrangement according to claim 20, wherein means are provided for selectively independently swinging each of said support legs to and from the storage position and in-use position.

24. An arrangement according to claim 23, wherein each of said support leg selective swinging means includes head plate means mounted at the respective support legs, segment means pivotally supported at each support leg, a selectively actuable displacement means mounted at each head plate means, and lever means for connecting said displacement means with said segment means.

25. An arrangement according to claim 24, wherein each of said displacement means includes a hydraulic assembly comprising at least one hydraulic cylinder means supported at said head plate means, and piston rod means actuable by said hydraulic cylinder means and connected to said lever means.

26. An arrangement according to claim 25, wherein at least two hydraulic cylinder means and at least two lever means are provided with a piston rod means of the respective hydraulic cylinder means being connected to a respective lever means.

27. An arrangement according to claim 26, wherein a distance between the respective support legs forms a base of the support legs, and means are arranged on said carrier elements for adjusting said base of the support legs,

28. An arrangement according to claim 27, wherein at least one further support means is provided and extends between one of said support legs and a respective bridge portion.

29. An arrangement according to claim 20, wherein said means for pivotally connecting said two carrier elements is a pivot axle extending in a direction substantially parallel to a longitudinal axis of the bridge.

* * * * *